US006761369B1

(12) United States Patent
Anderson

(10) Patent No.: US 6,761,369 B1
(45) Date of Patent: Jul. 13, 2004

(54) TRUCK FOR PREVENTING DAMAGE THERETO WHEN ATTACHED TO A SKATE BOARD AND NEGOTIATING AND CONTACTING A CURB

(76) Inventor: Scott D. Anderson, 517 E. Park Ave., Nashville, NC (US) 27856

( * ) Notice: Subject to any disclaimer, the term of this patent is extended or adjusted under 35 U.S.C. 154(b) by 29 days.

(21) Appl. No.: 10/261,837

(22) Filed: Sep. 30, 2002

(51) Int. Cl.[7] ..... B62M 1/00
(52) U.S. Cl. ..... 280/87.042; 280/11.27
(58) Field of Search ..... 280/87.041, 87.042, 280/87.05, 11.27, 11.28, 809, 842

(56) References Cited

U.S. PATENT DOCUMENTS

| | | | | | |
|---|---|---|---|---|---|
| 2,653,821 | A | | 9/1953 | Ware | |
| 3,362,722 | A | * | 1/1968 | Core | 280/87.041 |
| 3,992,025 | A | * | 11/1976 | Amelio | 280/87.042 |
| 4,047,727 | A | * | 9/1977 | Holladay et al. | 280/87.042 |
| 4,109,925 | A | | 8/1978 | Williams et al. | |
| 4,251,087 | A | | 2/1981 | Hansen | |
| 4,515,379 | A | * | 5/1985 | Pasques | 280/11.27 |
| 5,553,874 | A | | 9/1996 | Schouten et al. | |
| 5,971,411 | A | * | 10/1999 | Jones et al. | 280/87.042 |
| 6,019,382 | A | * | 2/2000 | Bouden | 280/87.042 |
| 6,056,302 | A | | 5/2000 | Smith | |
| 6,182,987 | B1 | | 2/2001 | Bryant | |
| 6,343,803 | B1 | * | 2/2002 | Johnston | 280/87.042 |
| 6,648,345 | B2 | * | 11/2003 | Lee | 280/11.27 |
| 6,648,372 | B2 | * | 11/2003 | Ojeda, III | 280/809 |
| 2002/0011713 | A1 | | 1/2002 | Kirkland | |

* cited by examiner

*Primary Examiner*—Bryan Fischmann
(74) *Attorney, Agent, or Firm*—Richard L. Miller, P.A.

(57) ABSTRACT

A truck for preventing damage thereto when attached to a skate board and negotiating and contacting a curb. A body attaches to the skate board and an axle extends rotatably through the body and terminates in a pair of wheels, respectively. A roller is rotatably positioned in the body and has the axle extend rotatably therethrough so as to prevent damage to the axle when the truck negotiates and contacts the curb, by virtue of the roller contacting the curb and rotating relative to the axle as the truck negotiates the curb.

7 Claims, 1 Drawing Sheet

TRUCK FOR PREVENTING DAMAGE THERETO WHEN ATTACHED TO A SKATE BOARD AND NEGOTIATING AND CONTACTING A CURB

BACKGROUND OF THE INVENTION

1. Field of the Invention

The present invention relates to a truck for a skate board. More particularly, the present invention relates to a truck for preventing damage thereto when attached to a skate board and negotiating and contacting a curb.

2. Description of the Prior Art

Numerous innovations for skate board truck assemblies have been provided in the prior art that will be described. Even though these innovations may be suitable for the specific individual purposes to which they address, however, they differ from the present invention.

A FIRST EXAMPLE, U.S. Pat. No. 2,653,821 to Ware teaches a roller skate structure comprising a frame arranged for connection at its upper side to a shoe or the like, a wheel axle support bracket, strut means interconnecting the support bracket and frame, and action screw interconnecting the frame and support bracket, said action screw being pivotally shiftable in respect to the frame and in respect to the support bracket, a member encircling the action screw adjacent the upper end thereof and removably connected to the frame for connecting the action screw to the frame, and means connected to the action screw adjacent its lower end for connecting the action screw to the support bracket.

A SECOND EXAMPLE, U.S. Pat. No. 4,109,925 to Williams teaches a skateboard truck that includes an axle assembly which is quickly detachable from the truck mounting paid by means of a tension bolt fitting within a slotted bracket in the mounting pad for quick detachment therefrom. The skateboard truck assembly Is provided with tension screw assembly that is mounted at a less than 45 degree angle with respect to the skateboard and includes adjusting means for adjusting the pivot axis of the assembly with respect to the skateboard totally independent of the adjustment of the tension in the assembly. A safety bracket includes a base portion with an arm having a cylindrical bore for receiving the cylindrical outer end of the tension bolt for reducing the stress on the board or tension bolt during the steering of the skateboard.

A THIRD EXAMPLE, U.S. Pat. No. 4,251,087 to Hansen teaches a truck apparatus for skate and skateboard devices including an elongated kingpin, means for affixing the upper end of the kingpin to the bottom of a load carrying platform at a selected angle and having a member disposed midway along the length of the kingpin and a friction surface and stop means, a wheel axle carriage assembly pivotally affixed to the lower end of the kingpin and adapted to rotate about the axis of the kingpin and having a second friction surface and stop lugs, a resilient drag sleeve and turn restoring element compressively disposed between the first and second friction surfaces, and a lock nut for selectively urging the carriage assembly toward the mid-portioned member so as to compress the drag sleeve between the first and second friction surfaces with a predetermined compression force such that the carriage assembly may be resistively and partially resiliently rotated about the axis of the kingpin within a range determined by the interaction of the stop lugs and the stop means and with a degree of freedom determined by the compression of the drag sleeve.

A FOURTH EXAMPLE, U.S. Pat. No. 5,553,874 to Schouten et al. teaches a roller board apparatus, such as a skateboard, having an elongated user support platform and front and rear rigid, curve axles mounted transversely across one side of the platform adjacent the front and rear ends, respectively. The axles curve symmetrically outwardly away from the platform surface to which they are attached and respectively include a plurality of wheels rotatably mounted therealong, thereby creating, in essence, an arc of wheels. Resilient, rubber, wedge shaped spacers are positioned between each end of the axles and the platform, for the primary purpose of causing the axles to angle outwardly away from one another so as to provide stability to the board. The spacers resiliency permit the angle at which each angle sits with respect to the horizontal to be selectively chaned. Different angles produce different riding characteristics. Among those different ride characteristics is included characteristics which accurately simulate the ride characteristics experience when surfing or snowboarding.

A FIFTH EXAMPLE, U.S. Pat. No. 6,056,302 to Smith teaches a skateboard truck assembly that includes a skateboard, a mounting plate, which is used to mount the truck assembly to the underside of the board, a mounting bracket to bridge the truck assembly to the mounting plate and an axle assembly, which includes axle rods, axle hubs and two wheels. The axle assembly is generally arcuate in shape and includes a lower surface with a more pronounced arcuate design and a central arched section. Each axle rod extends outwardly from the central arched section and slopes down to a terminus point adjacent to the inside portion of the wheel where the axle rod flares relative to the size of the axle hub to conform to the interior sidewall of the wheel and the underside of the flared axle rod coincides in substantial aligned relation with the corresponding wheel tread.

A SIXTH EXAMPLE, U.S. Pat. No. 6,182,987 B1 to Smith teaches an improved skate or skateboard truck which incorporates precision steering and rocking components for consistency and accuracy during maneuvers and a method for removing or replacing worn or broken axles. A yoke containing the truck's axle includes a central body portion into which a precision ball socket has been machined. It is jointed by a spherical component for the yoke to pivot around. It is also fitted with a precision ball pivot pin opposite the socket which will act as the associate pivotal and rocking mechanism for the truck assembly. The base is comprised of a central body into which a stud is secured for mounting the yoke and a pocket has been machined for containing a precision ball socket to accept the associate ball pivot pin. A slotted configuration situated at each end of the yoke can be compressed with screws to allow the axle to be removed or replaced.

A SEVENTH EXAMPLE, U.S. Pat. Application Publication No. US2002/0011713 A1 to Kirkland teaches a truck assembly for a skateboard that includes an axle housing, a base, and a kingpin connecting the axle housing and base. The kingpin holds the axle housing and a base surface of the base a predetermined distance apart. The truck further includes a turning mechanism between the axle housing and base, around the kingpin. The turning mechanism includes opposed cam surfaces that are angled along the axis of the kingpin and an elastomeric bushing so that rotating the axle housing about the kingpin pushes the cam surfaces apart, against the compression pressure of the elastomeric bushing. The elastomeric bushing may be located within a coiled spring. The truck assembly additionally includes an adjustment mechanism for adjusting the pressure against the bushing. The adjustment mechanism includes an adjustment surface on the base of the truck assembly with two or more adjustment pints, each a different distance from the base surface along the direction of the kingpin. An adjustment ring surrounds the kingpin, between the base surface and the turning mechanism. The adjustment ring includes adjustment lobes that engage the adjustment surface on the base.

It is apparent that numerous innovations for skate board truck assemblies have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a truck for preventing damage thereto when attached to a skate board and negotiating and contacting a curb that avoids the disadvantages of the prior art.

ANOTHER OBJECT of the present invention is to provide a truck for preventing damage thereto when attached to a skate board and negotiating and contacting a curb that Is simple to use.

BRIEFLY STATED, STILL ANOTHER OBJECT of the present invention is to provide a truck for preventing damage thereto when attached to a skate board and negotiating and contacting a curb. A body attaches to the skate board and an axle extends rotatably through the body and terminates in a pair of wheels, respectively. A roller is rotatably positioned in the body and has the axle extend rotatably therethrough so as to prevent damage to the axle when the truck negotiates and contacts the curb, by virtue of the roller contacting the curb and rotating relative to the axle as the truck negotiates the curb.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
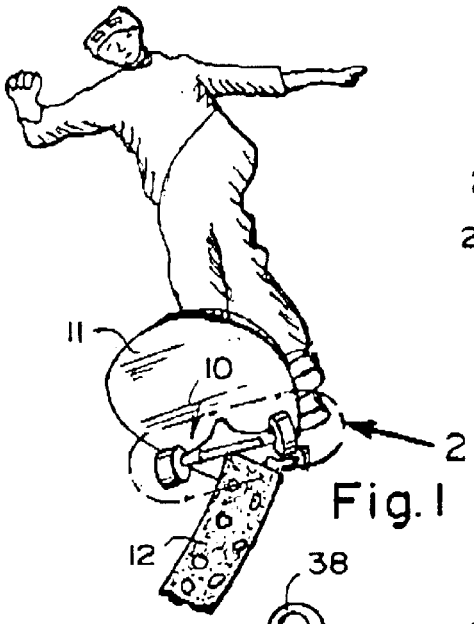
FIG. 1 is a diagrammatic perspective view of the present invention in use.

| | |
|---|---|
| 10 | truck of present invention for preventing damage thereto when attached to skate board 11 and negotiating and contacting curb 12 |

-continued

LIST OF REFERENCE NUMERALS UTILIZED IN THE DRAWING

| | |
|---|---|
| 11 | skate board |
| 12 | curb |
| 14 | body |
| 16 | axle |
| 18 | pair of wheels |
| 20 | roller for preventing damage to axle 16 when truck 10 negotiates and contacts curb 12, by virtue of roller 20 contacting curb 12 and rotating relative to axle 16 as truck 10 negotiates curb 12 |
| 22 | center portion of body 14 for attaching to skate board 11 |
| 24 | bifurcations of center portion 22 of body 14 |
| 26 | pair of ends of axle 16 |
| 28 | pair of nuts |
| 30 | outer tube of roller 20 |
| 32 | inner tube of roller 20 |
| 34 | six bearings of roller 20 |
| 36 | four spacers of roller 20 |
| 38 | two C-clips of roller 20 |
| 40 | pair of ends of outer tube 30 of roller 20 |
| 42 | interior surface of outer tube 30 of roller 20 |
| 44 | pair of circumferential grooves in outer tube 30 of roller 20 |

DETAILED DESCRIPTION OF THE PREFERRED EMBODIMENT

Referring now to the figures, in which like numerals indicate like parts, and particularly to FIG. 1, the truck of the present invention is shown generally at 10 for preventing damage thereto when attached to a skate board 11 and negotiating and contacting a curb 12.

Figure 2:
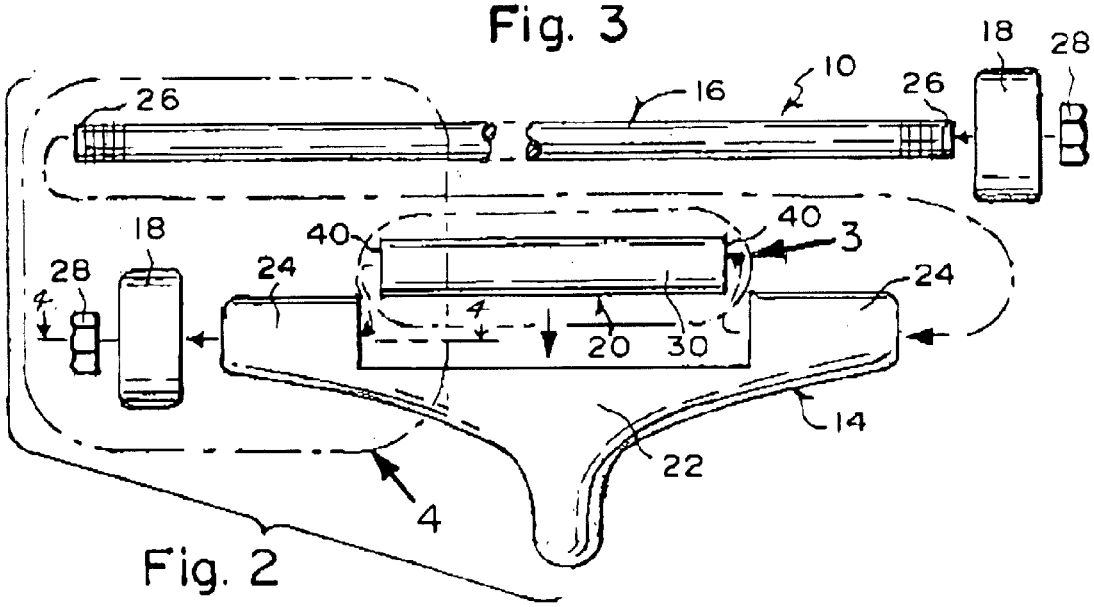
FIG. 2 is an enlarged exploded view of the area generally enclosed by the dotted curve identified by arrow 2 in FIG. 1 of the present invention.

The overall configuration of the truck 10 can best be seen in FIG. 2, and as such, will be discussed with reference thereto.

The truck 10 comprises a body 14, an axle 16, and a pair of wheels 18. The body 14 is for attaching to the skate board 11, and the axle 16 extends rotatably through the body 14, and terminates in the pair of wheels 18, respectively.

The truck 10 further comprises a roller 20. The roller 20 is rotatably positioned in the body 14, and has the axle 16 extend rotatably therethrough. The roller 20 is for preventing damage to the axle 16 when the truck 10 negotiates and contacts the curb 12, by virtue of the roller 20 contacting the curb 12 and rotating relative to the axle 16 as the truck 10 negotiates the curb 12.

The body 14 is generally yoke-shaped, and has a center portion 22 with bifurcations 24. The center portion 22 of the body 14 is for attaching to the skate board 11.

The axle 16 is slender, elongated, and has a pair of ends 26 that are threaded. The axle 16 extends rotatably through the bifurcations 24 of the center portion 22 of the body 14, to a point where the pair of ends 26 of the axle 16 extend past the bifurcations 24 of the center portion 22 of the body 14, respectively.

The pair of wheels 18 are disposed on the pair of ends 26 of the axle 16, respectively, and are maintained thereat, by a pair of nuts 28 threadably engaging the pair of ends 26 of the axle 16, respectively.

Figure 4:
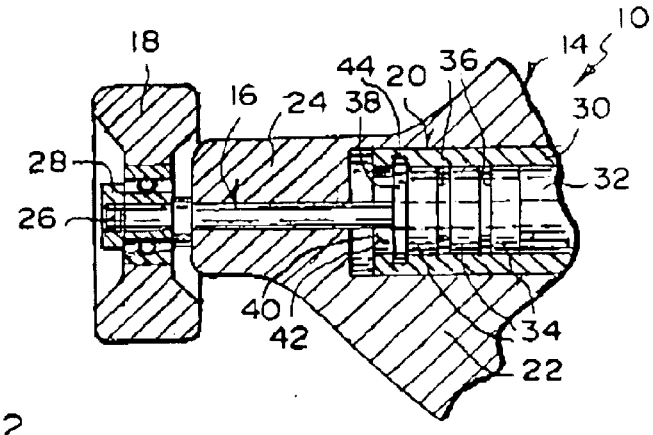
FIG. 4 is an enlarged diagrammatic partial cross sectional view, with parts broken away, taken in the direction of the arrows along line 4—4 in the area enclosed by the dotted curve also indicated by an arrow 4 in FIG. 2 after assembly.
Figure 3:
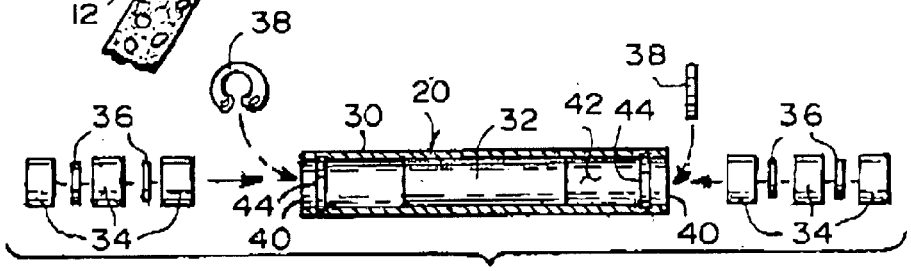
FIG. 3 is an exploded diagrammatic side elevational view in partial section of the area generally enclosed by the dotted curve identified by arrow 3 in FIG. 2.

The specific configuration of the roller 20 and its interface with the body 14 can best be seen in FIGS. 3 and 4, and as such, will be discussed with reference thereto.

The roller 20 is rotatably disposed between the bifurcations 24 of the center portion 22 of the body 14, and comprises an outer tube 30, an inner tube 32, six bearings 34, four spacers 36, and two C-clips 38. The outer tube 30 has a pair of ends 40 and an interior surface 42.

The outer tube 30 further has a pair of circumferential grooves 44. The pair of circumferential grooves 44 extend in the interior surface 42 of the outer tube 30, at the pair of ends 40 thereof, respectively.

The inner tube 32 extends coaxially, snugly, and centrally in the outer tube 30, and rotatably receives the axle 16.

Three bearings 34, separated by two spacers 36, respectively, are positioned in each end 40 of the outer tube 30, and abut against the inner tube 32, which provides an inner stop for the six bearings 34.

The two C-clips 38 are engaged in the pair of grooves 44 in the outer tube 30, respectively, and provide an outer stop for the six bearings 34.

It will be understood that each of the elements described above, or two or more together, may also find a useful application in other types of constructions differing from the types described above.

While the invention has been illustrated and described as embodied in a truck for preventing damage thereto when attached to a skate board and negotiating and contacting a curb, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A truck for preventing damage when attached to a skate board and negotiating and contacting a curb, said truck comprising:

a body;

b) an axle; and c) a pair of wheels;

wherein said body is for attaching to the skate board;

wherein said axle extends rotatably through said body; and wherein said axle terminates in said pair of wheels, respectively; further comprising a roller;

wherein said roller is rotatable positioned in said body;

wherein said roller has said axle extend rotatably therethrough; and wherein said roller is for preventing damage to said axle when said truck negotiates and contacts the curb, by virtue of said roller contacting the curb and rotating relative to said axle as said truck negotiates the curb, wherein said body is generally yoke-shared;

wherein said body has a center portion;

wherein said body has bifurcations; and wherein said center portion of said body is for attaching to the skate board, wherein said roller is rotatably disposed between said bifurcations of said center portion of said body;

wherein said roller comprises an outer tube;

wherein said roller comprises an inner tube;

wherein said roller has attached six bearings;

wherein said roller has attached four spacers;

wherein said roller has attached two C-clips;

wherein said outer tube has a pair of ends; and wherein said outer tube has an interior surface.

2. The truck as defined in claim 1, wherein said axle is slender;

wherein said axle is elongated;

wherein said axle has a pair of ends;

wherein said pair of ends of said axle are threaded;

wherein said axle extends rotatably through said bifurcations of said center portion of said body, to a point where said pair of ends of said axle extend past said bifurcations of maid center portion of said body, respectively.

3. The truck as defined in claim 2, wherein said pair of wheels are disposed on said pair of ends of said axle, respectively;

wherein said pair of wheels are maintained on said pair of ends of said axle, respectively, by a pair of nuts; and wherein said pair of nuts threadably engage said pair of ends of said axle, respectively.

4. The truck as defined in claim 1, wherein said outer tube has a pair of circumferential grooves;

wherein said pair of circumferential grooves extend in said interior surface of said outer tube; and wherein said pair of circumferential grooves are disposed at said pair of ends of said outer tube, respectively.

5. The truck as defined in claim 4, wherein said two C-clips are engaged in said pair of grooves in said outer tube, respectively; and wherein said two C-clips provide an outer stop for said six bearings.

6. The truck as defined in claim 1, wherein said inner tube extends coaxially in said outer tube;

wherein said inner tube extends snugly in said outer tube;

wherein said inner tube extends centrally in said outer tube; and wherein said inner tube rotatably receives said axle.

7. The truck as defined in claim 1, wherein three bearings of said six bearings, are separated by two spacers, respectively, are positioned at each end of said outer tube, and abut against said inner tube, which provides an inner stop for said three at each end of said outer tube bearings.

* * * * *